US009282410B2

(12) United States Patent
Gladwin et al.

(10) Patent No.: US 9,282,410 B2
(45) Date of Patent: Mar. 8, 2016

(54) TRANSDUCER MOTOR STRUCTURE WITH ENHANCED FLUX

(71) Applicant: Definitive Technology, LLC, Owings Mills, MD (US)

(72) Inventors: Timothy A. Gladwin, Pakenham (CA); Jason B. Cochrane, Arnprior (CA); David D. Logan, Pakenham (CA)

( * ) Notice: Subject to any disclaimer, the term of this patent is extended or adjusted under 35 U.S.C. 154(b) by 0 days.

(21) Appl. No.: 14/338,088

(22) Filed: Jul. 22, 2014

(65) Prior Publication Data

US 2015/0030199 A1 Jan. 29, 2015

Related U.S. Application Data

(60) Provisional application No. 61/858,446, filed on Jul. 25, 2013.

(51) Int. Cl.
*H04R 1/00* (2006.01)
*H04R 9/02* (2006.01)

(52) U.S. Cl.
CPC ..... *H04R 9/025* (2013.01)

(58) Field of Classification Search
CPC ..... H04R 9/025; H04R 2209/022
USPC ..... 381/396, 412, 414
See application file for complete search history.

(56) References Cited

U.S. PATENT DOCUMENTS

| | | | | |
|---|---|---|---|---|
| 7,283,642 | B2 * | 10/2007 | Milot | H04R 9/025 381/400 |
| 7,684,582 | B2 * | 3/2010 | Gladwin et al. | 381/337 |
| 2004/0131223 | A1 * | 7/2004 | Stiles | 381/412 |

* cited by examiner

*Primary Examiner* — Sunita Joshi
(74) *Attorney, Agent, or Firm* — J. Andew McKinney, Jr.; McKinney & Associates, LLC.

(57) ABSTRACT

An electro-dynamic loudspeaker transducer's motor structure includes a magnetic circuit having a pole with minimal reluctance that allows the use of larger magnets and thicker front plates, thus generating higher flux density in the voice coil gap. The lower reluctance is achieved by increasing the pole piece's outside diameter at all points outside of the voice coil gap and the area swept out by the voice coil at maximal inward excursion. Increasing the pole's diameter over a substantial amount of the pole's distally projecting length (but not extending into the magnetic gap), provides an increased cross sectional area and a reduced magnetic circuit reluctance.

15 Claims, 6 Drawing Sheets

TRANSDUCER MOTOR STRUCTURE WITH ENHANCED FLUX

PRIORITY CLAIM AND REFERENCE TO RELATED APPLICATIONS

This application claims the benefit of U.S. Provisional Patent Application No. 61/858,446 of Timothy A. Gladwin et al, filed Jul. 25, 2013 and entitled "Transducer Motor Structure with Enhanced Flux", the disclosure of which is hereby incorporated herein in its entirety by reference. This application is also directed to improvements in Loudspeakers such as those described in commonly-owned U.S. Pat. No. 7,684,582, the entire disclosure of which is incorporated herein in its entirety.

BACKGROUND OF THE INVENTION

1. Field of the Invention

The present invention relates to electro-dynamic transducer motor structures and, more particularly, to enhanced magnetic circuits in loudspeaker drivers.

2. Discussion of the Prior Art

Loudspeakers such as shown in commonly-owned U.S. Pat. No. 7,684,582 and in U.S. Pat. No. 7283,642 (Milot et al) convert electrical signal energy into acoustic energy by driving a diaphragm. FIG. 1 illustrates a prior art dome tweeter 11 (as disclosed in Milot's U.S. Pat. No. 7,283,642) using a moving-coil electrodynamic motor generally indicated at 10. The moving coil electrodynamic motor includes at least one permanent magnet 13 having two magnetic poles, a front plate or front pole piece 12 and a two-part rear pole piece having a proximal circular base 14 and a cylindrical, upwardly extending hollow distal projection 14', with the annular permanent magnet 13 disposed between the front pole piece and the base of the rear pole piece. An annular magnetic gap 210 is defined between an inner circumferential edge of the front plate 12 and an outer circumferential edge of the sidewall of an annular distal projection 14' of the rear pole piece 14. The front plate 12 and the rear pole piece 14 and its projection 14' form a magnetic circuit which directs magnetic flux from the permanent magnet 13 into and across the magnetic gap 210. A dome-shaped tweeter diaphragm 16 is connected at its lower peripheral edge to a bobbin which carries a conductive voice coil 15 and is disposed in the annular magnetic gap 210 to allow the diaphragm to reciprocate along Z-axis 220 when driven.

The dome-shaped diaphragm 16 and the coil 15 of the Milot patent are connected to and supported by a surrounding chassis 17 by a peripheral suspension 18 to permit tweeter diaphragm movement. The distal projection or protrusion 14' of the rear pole piece 14 is open at its center for the passage of conductive (positive and negative) audio signal leads 40 which are connected to the coil 15 to drive the diaphragm. The rear pole piece 14 and the front pole piece 12 may be annular, or ring shaped, are disposed at respective opposing poles of the magnet 13 and may be made of metal, such as soft iron. In this prior art tweeter, the magnetic circuit which directs flux from magnet 13 into annular magnetic gap 210 includes a first grooved surface 205 in the inner edge of the front plate 12 opposing a second grooved surface 206 in the outer circumferential edge of the sidewall of distal projection 14', and those opposing grooved surfaces are intended to create distinct "zones" within magnetic gap 210, although the Milot patent does not exactly show how the magnetic flux lines are affected.

FIG. 2 illustrates in cross section another prior art loudspeaker motor structure 30, showing lines 32 of magnetic flux passing through parts of the motor's magnetic circuit, which includes a permanent magnet 34, a front plate 36, and a pole piece 38 having a distally (upwardly) projecting central segment 40 with an outer sidewall surface 42 defining part of a magnetic gap 44 between surface 42 and an inner circumferential surface 46 of the front plate 36. In the tweeter motor structure 30 of FIG. 2, the magnetic circuit which directs flux 32 from the annular permanent magnet 34 into the annular magnetic gap 44 includes the first surface 46 in the inner edge of the front plate 36 opposing the second surface 42 on the distal-most outer circumferential edge 42 of the sidewall of the rear pole piece's distal projection 40. The continuous lines of flux originate in the annular permanent magnet 34 and are enhanced by a proximal bucking magnet 105 located adjacent, and on the opposite side of, the rear pole piece 38. These lines of flux are shown as guided into and though the magnetic gap by the magnetic circuit. Typically, the pole piece of a well designed transducer motor is the choke point for the magnetic flux; that is, the pole piece, in this case pole piece 38, usually controls the overall reluctance. The amount of magnetic flux in the circuit is controlled by the amount of magnetic reluctance. Persons of skill in the art will recall that reluctance in a magnetic circuit is analogous to impedance in an electrical circuit. In a manner similar to the way an electric field causes an electric current to follow the path of least resistance, a magnetic field causes magnetic flux to follow the path of least magnetic reluctance.

That the pole piece is the magnetic circuit choke point for a transducer motor is particularly true for tweeters such as those shown in FIGS. 1 and 2, where low diaphragm mass and small diameter are crucial. The flux-carrying capacity of the pole piece must be sufficient to maintain high levels of magnetic saturation, while the needs for small diameter and low mass place limits on the thickness of the front plate. High levels of saturation are necessary to reduce overall inductance and non-linear inductance (e.g., solenoid) effects in a tweeter, which matters because high inductance will reduce high frequency sensitivity. The pole reluctance limits both the useful gap width and the largest magnet size that can be effectively utilized, and these limiting factors limit tweeter performance. For example, Applicants have discovered that for a useful tweeter size which uses a 25 mm pole, the front plate thickness is limited to 3 mm to meet the saturation criteria and this limits the useful magnet diameter to approximately 70 mm. With only 3 mm of gap width, and a typical winding width of 1.5 mm, there is only 0.75 mm of total theoretical excursion in the motor. This excursion is severely reduced by both fringing flux and by the voice coil positional tolerance to a typical value of 0.3 mm.

There is a need, therefore, for a practical and effective structure and method to enhance the performance of magnetic circuits, especially those used loudspeaker motors such as tweeter motors.

SUMMARY OF THE INVENTION

In accordance with the present invention, a transducer motor is configured to provide higher flux than can be achieved using prior art motor structures. The method of the present invention specifically applies to so-called under hung motors with standard (e.g., ceramic) magnets, such as are commonly used for tweeters, but persons having skill in the art will see that the instant method and structure could be applied to a variety of transducer configurations. In an electro-dynamic transducer motor, higher flux is desirable to achieve either higher output levels (sensitivity) or increased linear output (lower distortion), or a combination of both.

In a typical prior art transducer motor (e.g., as shown in FIG. 1 or 2), the magnetic circuit provides a substantially static magnetic field against which the current in the voice coil interacts to produce voice-coil driven diaphragm motion. The force produced is described by Eq. 1, as follows:

$$\text{Force}=B\times L\times I \quad (1)$$

where B is the flux density, or strength, of the magnetic field, L is the effective length of the conductor in the voice coil and I is the current in the voice coil. In high performance loudspeakers, it is important to have a high flux level and a linear flux level over the range of motion of the voice coil to reduce distortion. The current invention provides both higher flux levels and longer linear flux range than prior art motor structures.

As noted above, the pole piece in the magnetic circuit of a typical well designed transducer motor was the choke point for the magnetic flux, that is, the pole usually controlled the overall reluctance of the circuit and the amount of magnetic flux in the circuit was controlled by the amount of reluctance. (In a first order approximation, reluctance in a circuit element is inversely proportional to the cross sectional area normal to the direction of the flux lines and is proportional to the length of the circuit element, where the length is defined as the dimension of the element parallel to the flux lines.) That the pole is the choke point is particularly true for tweeters, where low mass and small diameter are crucial. The flux carrying capacity of the pole piece limits the thickness of the front plate to maintain high levels of magnetic saturation. The high levels of saturation are necessary to reduce overall inductance and non-linear inductance effects.

The pole reluctance limits both the useful gap width and the largest permanent magnet size that can be effectively utilized. The present invention is directed to a pole with minimal reluctance that allows the use of larger magnets, thicker front plates and realizes higher flux density in the air gap. The lower reluctance is achieved by increasing the pole piece outside diameter at all points outside of the gap and the area swept out by the voice coil at maximal inward excursion. In accordance with the present invention, by increasing the pole diameter over a substantial amount of its distally projecting length (but not extending into the magnetic gap), the cross sectional area is increased, which reduces the reluctance. Persons skilled in the art will see that the increase in pole projection diameter must be balanced against the adverse effects of providing fringing flux paths that divert flux away from the focused flux in the gap, and that the increase in diameter must be located proximally spaced from the magnetic gap so that the voice coil will not contact the pole projection's larger diameter sidewall segment during any achievable voice coil bobbin excursion.

In general terms, the magnetic structure of a transducer motor in accordance with the invention includes an annular permanent magnet having a central lumen defined around a central axis and having an axial length, with a first pole at a first surface of the permanent magnet and a second pole at a second surface of the magnet. The magnetic structure also has an annular front plate proximate the magnet's first surface, the front plate having a central lumen defining an inner edge with a thickness defined as front plate inner edge axial length, where the front plate lumen has a selected lumen inside diameter. A rear pole piece proximate the magnet's second surface has a distally, or upwardly, projecting axially aligned pole piece segment configured to be received in the magnet's central lumen and having a sidewall with an outer circumferential edge. An annular magnetic gap is defined between the inner edge of the front plate and the outer circumferential edge of the sidewall of the distally projecting pole piece segment. The distally projecting axially aligned pole piece segment's sidewall has a reluctance-reducing segment having an enlarged outside diameter and this tapers distally into a distal segment having a second outside diameter which is smaller than the enlarged outside diameter. The outside diameter of the distally projecting pole piece's reluctance-reducing enlarged segment can be larger than the front plate lumen's inside diameter.

The magnetic circuit structure of the present invention thus includes a pole with minimal reluctance that allows the use of larger magnets, thicker front plates and realizes higher flux density in the air gap. The lower reluctance is achieved by increasing the pole outside diameter at all points proximally spaced from and outside of the gap and the area swept out by the reciprocating voice coil bobbin at maximal inward excursion.

By increasing the pole diameter over a substantial amount of its distally projecting length, the cross sectional area is increased, which reduces the reluctance. Persons of skill in the art will appreciate that the increase in pole projection outside diameter must be balanced with the potential to provide flux paths that divert flux away from the gap, and that the increase in diameter must be located so that the voice coil bobbin will not contact the pole during any achievable excursion.

BRIEF DESCRIPTION OF THE DRAWINGS

The above and still further features and advantages of the present invention will become apparent upon consideration of the following detailed description of a specific embodiment thereof, particularly when taken in conjunction with the accompanying drawings, wherein like reference numerals in the various figures are utilized to designate like components, and wherein.

DESCRIPTION OF THE PREFERRED EMBODIMENT

Figure 1:
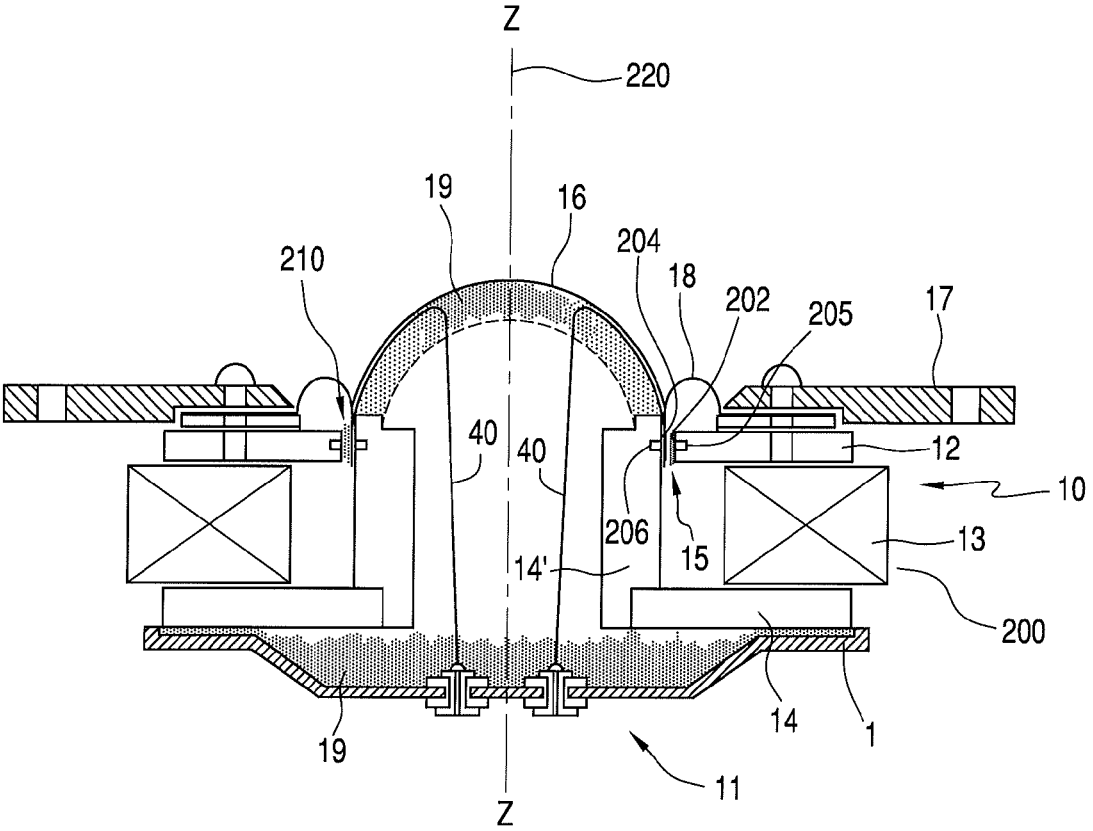
FIG. 1 PRIOR ART
FIG. 1 is a cross-section of a prior art tweeter described in U.S. Pat. No. 7,283,642 (Milot et al)
Figure 2:
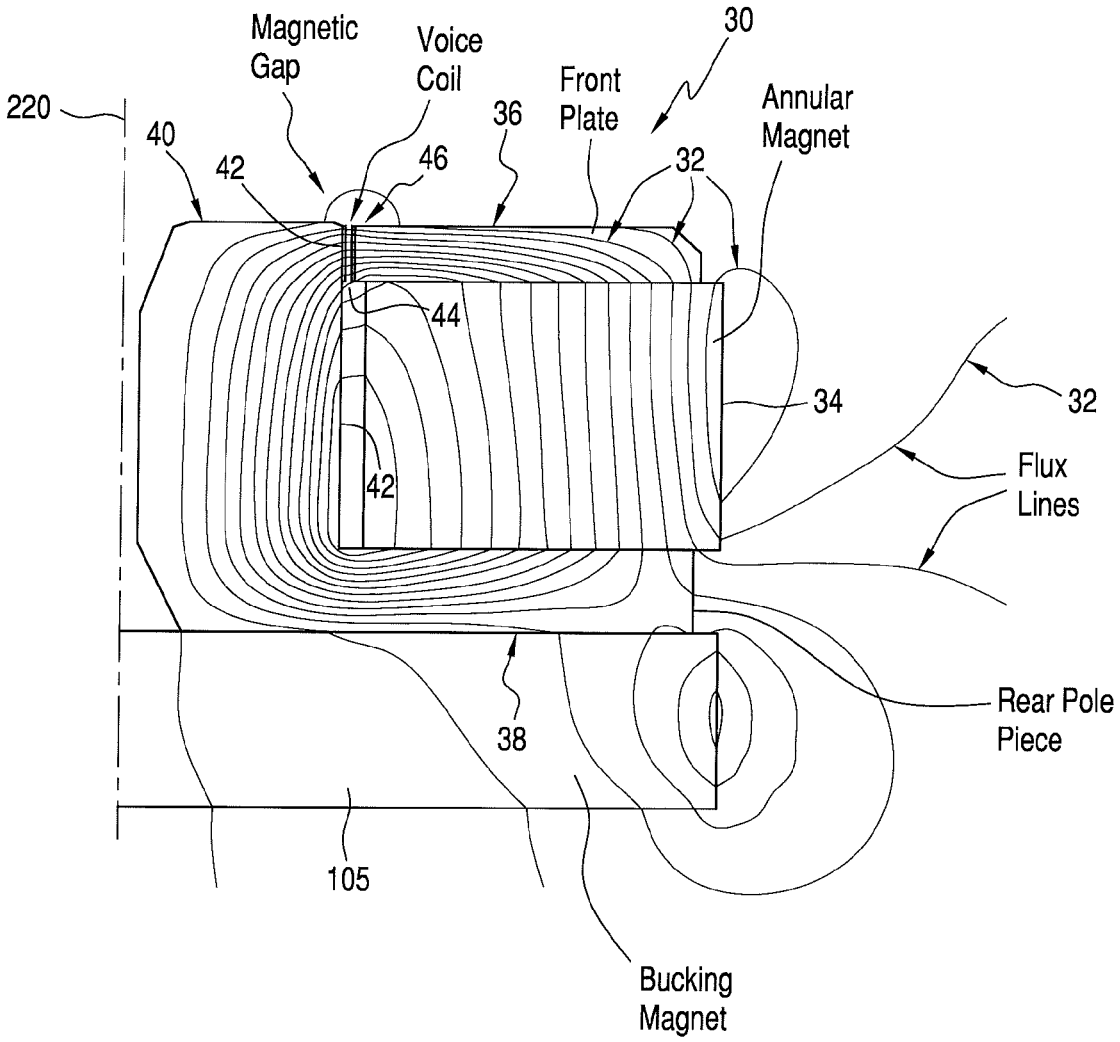
FIG. 2 PRIOR ART
FIG. 2 is a partial cross-sectional view of another prior art tweeter structure.
Figure 3:
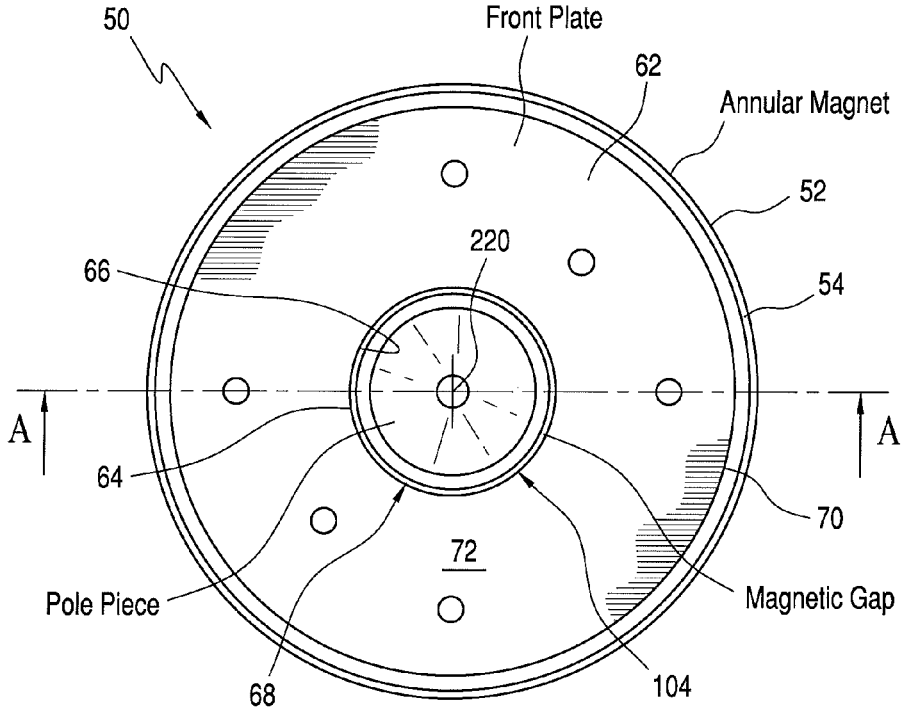
FIG. 3 is a top plan view of a loudspeaker drive motor structure in accordance with the present invention.
Figure 4:
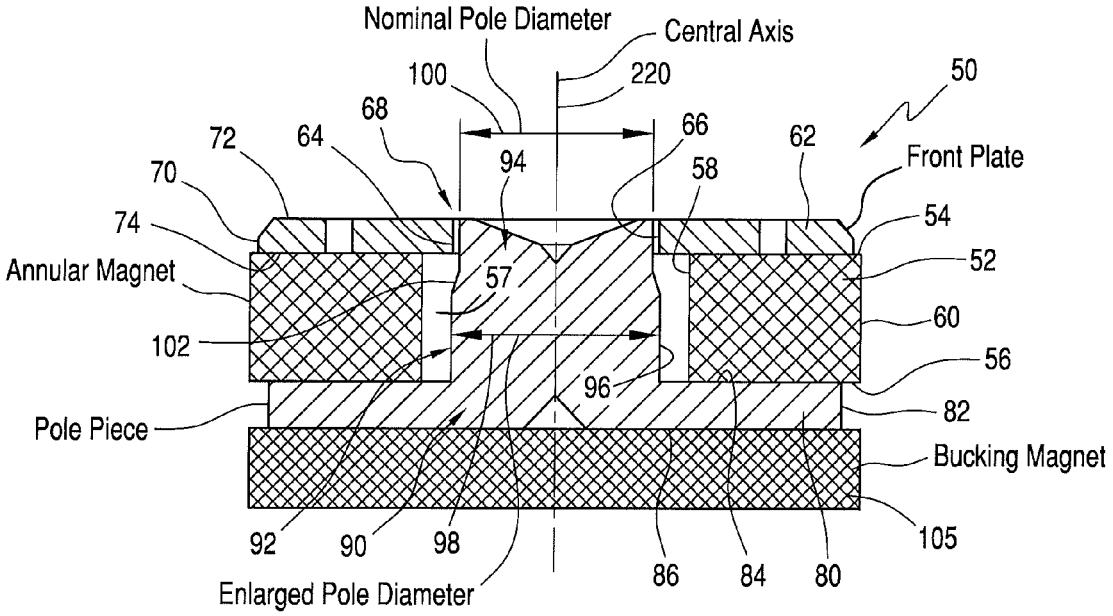
FIG. 4 is a cross-sectional view of the motor of FIG. 3, taken along line A-A of FIG. 3.
Figure 5:
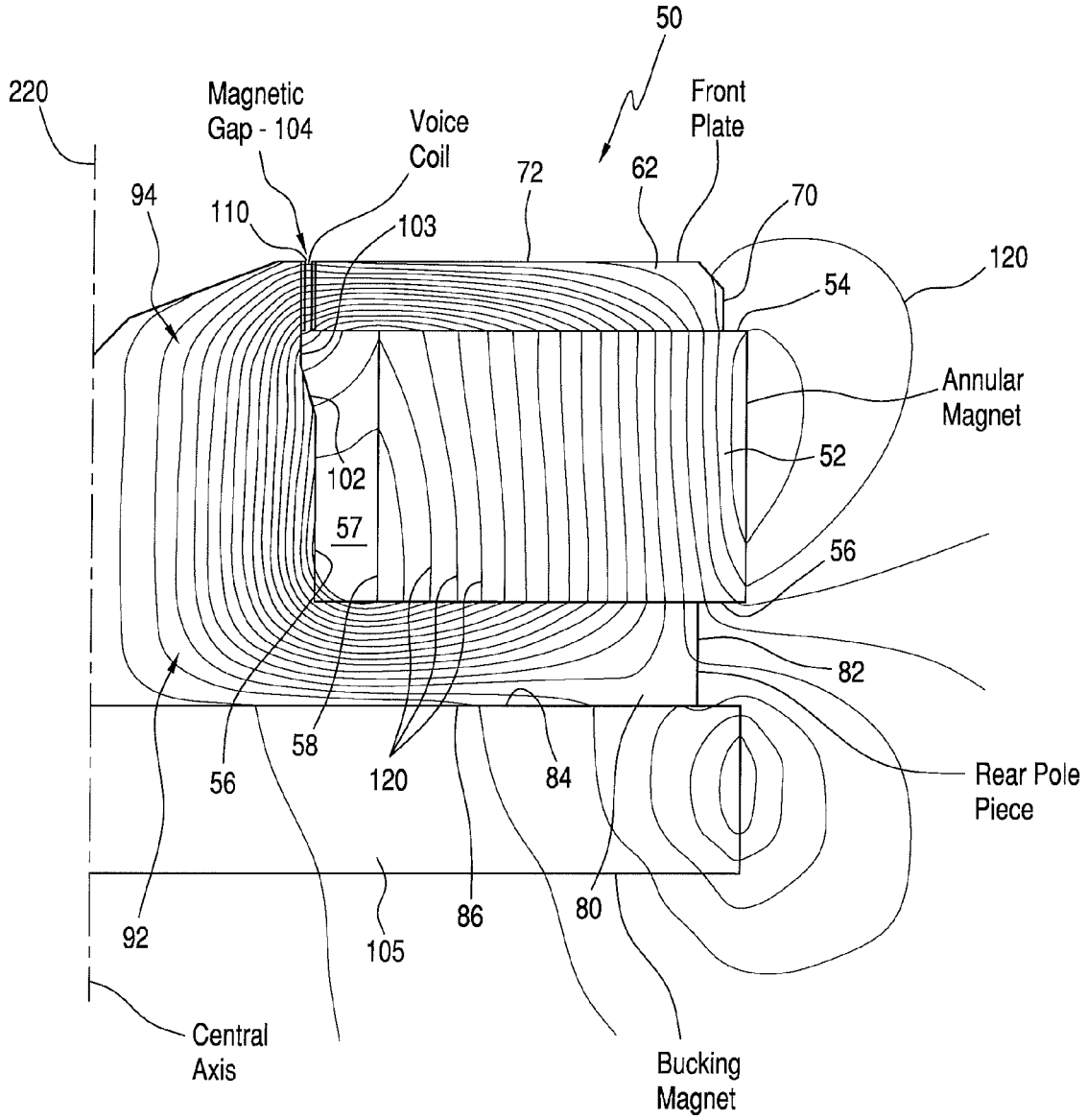
FIG. 5 is an enlarged view of a portion of the cross-section of FIG. 4. Illustrating magnetic flux lines.

Turning now to a more detailed description of the loudspeaker motor of the present invention, FIGS. 3-5 illustrate an enhanced loudspeaker motor structure 50 that provides improved magnetic circuit performance and provides higher flux force than can be achieved using the prior art motor structures of FIGS. 1 and 2. The method of the present invention is especially well suited for use with so-called "under hung" motors with ceramic magnets, such as used for tweeters, but persons having skill in the art will see that the instant method and structure could be applied to a variety of transducer configurations. In an electro-dynamic transducer motor, higher flux is desirable to achieve either higher output levels (sensitivity) or increased linear output (lower distortion), or a combination of both.

As illustrated in FIGS. 3 and 4, the motor 50 incorporates a conventional, annular permanent magnet 52 having an upper pole surface 54 and a lower pole surface 56, an inner cylindrical lumen, or aperture 57 around a central Z axis such as the axis 220 of FIG. 1. The aperture is defined by an inner surface 58 of the magnet, which also includes an outer cylindrical surface 60. Mounted on and in contact with the upper pole surface 54 is an annular front plate 62 which forms an upper pole piece for the motor. This front plate has a central lumen, or aperture 64 having a selected inner diameter defined by an inner circumferential edge, or wall 66 and has a thickness which defines a front plate axial length of a magnetic gap 68. The front plate has an outer, preferably cylindrical outer circumferential wall 70, and upper and lower surfaces 72 and 74, with the lower surface 74 engaging the upper surface 54 of the permanent magnet.

The motor 50 also incorporates a lower or rear pole piece 80 mounted on and in contact with the lower surface 56 of the permanent magnet 52. Pole piece 80 is generally annular, with an outer cylindrical wall 82 and upper and lower surfaces 84 and 86, with the upper surface 84 engaging the lower surface 56 of the permanent magnet. A central, axially aligned, distally-projecting portion 90 of the lower, or rear pole piece 80 includes a first, larger-diameter portion 92 that protrudes upwardly through the central lumen, or aperture 57 of the permanent magnet, and a second, stepped-down smaller diameter upper segment 94 that protrudes upwardly into and through the central aperture 64 of the front plate 62. This central portion 90 of the lower pole piece is generally cylindrical and has an outer wall 96 that has an enlarged pole diameter 98 in its lower segment 92, which is centrally located in, and is spaced from, the inner wall 58 of the permanent magnet. As illustrated in FIG. 4, the outer wall 96 of the pole piece segment 92 steps down, or tapers inwardly, at 102, below the front plate 62, to form at the nominal-diameter upper segment 94 of the pole piece an outer circumferential edge 103 extending into the lumen 64 of the front plate. The spacing between the outer edge of pole piece portion 94 and the inner edge 66 of the front plate 62 forms an annular magnetic gap 104 for the magnetic circuit of motor 50, in which a movable voice coil 110 may be mounted, as illustrated in the enlarged view of FIG. 5.

The permanent magnet 52 generates a magnetic field, illustrated by flux lines 120 in FIG. 5 which flow between the poles of the magnet and through the magnetic circuit, which includes the permanent magnet 52, the upper front plate 62, the lower pole piece 80 and its central portion 90, with its enlarged segment 92 as well as its nominal-diameter segment 94, and the magnetic gap 104, to produce a strong and consistent field in and along the axial length of the magnetic gap 104. Also, as illustrated in FIGS. 4 and 5, the motor structure of the present invention may incorporate a bucking magnet 105 to provide additional magnetic field strength for the device.

The magnetic circuit structure 50 of the present invention provides both higher flux levels and longer linear flux range than prior art motor structures. As noted above, the amount of magnetic flux in the circuit is controlled by the reluctance of the circuit. The reluctance in a given circuit element is inversely proportional to the cross sectional area of that element normal to the direction of the flux lines such as those illustrated in FIG. 5, and is proportional to the length of the circuit element, where the length is defined as the dimension of the element parallel to the flux lines. The flux carrying capacity of one circuit element, such as the pole piece 80, places an upper limit on the permitted thickness of another circuit element, such as the front plate 52 if a desired high level of magnetic saturation is to be maintained in the circuit. As noted above, high levels of saturation are necessary in a loudspeaker motor, particularly for a tweeter, to reduce overall inductance and non-linear inductance effects.

Since pole reluctance limits both the useful gap width and the largest magnet size that can be effectively utilized, a solution was sought which would minimize the effect of pole reluctance, but without adversely effecting magnetic flux in the gap. The magnetic circuit of present invention as illustrated in FIGS. 3-5 provides such a solution through the use of the enlarged diameter segment 92 for the upstanding portion 90 of the pole piece 80. This segment 92 provides a minimal reluctance circuit element that allows the use of larger magnets and thicker front plates and realizes higher flux density in the air gap 104. The lower reluctance is achieved by increasing the diameter 98 of pole segment 92 at all points outside of the air gap 104 and outside the region of the pole that is swept by motion of the voice coil 110 vertically (as viewed in FIGS. 4 and 5) through the magnetic gap 104 at its maximal inward excursion.

In accordance with the present invention, by increasing the pole diameter 98 over a substantial amount of its distally (upwardly, as viewed in FIG. 5) projecting length, but not extending into the magnetic gap, as indicated at enlarged segment 92, the cross sectional area of this portion of the magnetic circuit is increased, and this reduces the reluctance of this circuit element. Persons skilled in the art will see that the increase in pole projection diameter must be balanced against the adverse effects of providing fringing flux paths that divert flux away from the focused flux in the gap 104, and that the increase in diameter indicated by the stepped portion 102 must be located proximally spaced from the magnetic gap 104 so that the voice coil will not contact the pole projection's larger diameter sidewall segment 92 during any achievable voice coil bobbin excursion. Although not illustrated in FIGS. 3-5, it will be understood that the motor 50 will be mounted in a suitable chassis, such as the chassis 17 of FIG. 1, and that the voice coil 110 may be wound on a bobbin for a movable tweeter diaphragm that also may be mounted, as by a suitable suspension, to the chassis so that current flow in the voice coil produces corresponding vertical excursions in the in the coil and the diaphragm.

Figure 6:
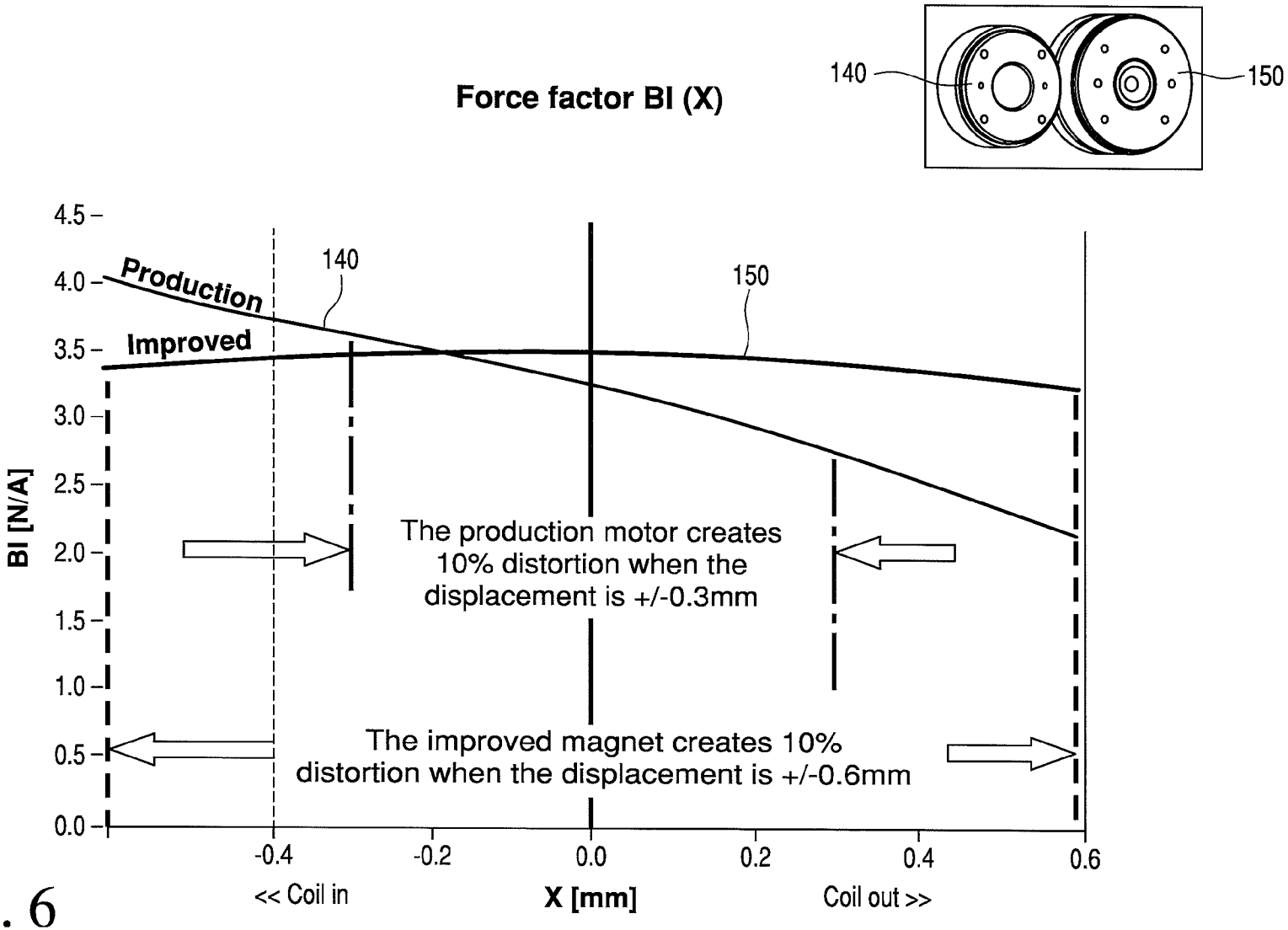
FIG. 6 is a performance chart comparing characteristics of the loudspeaker motor of the present invention with those of a prior art motor.

Referring now to FIG. 6, which compares the force factor BL (X) for a prior art loudspeaker motor 140 with the force factor for one of applicant's prototype motors 150, over the length of axial motion of the motor voice coil it was found that the improved structure of the present invention, as described above, significantly increased the available useful displacement. A prior art tweeter transducer of a useful size uses a 25 mm nominal diameter pole rear pole piece, which limits the front plate thickness to 3 mm to meet the saturation criteria and limits the useful magnet diameter to approximately 70 mm. With only 3 mm of gap width, and a typical winding width of 1.5 mm, there is only 0.75 mm of total theoretical excursion in the motor. This excursion is severely reduced by both fringing flux and by the voice coil positional tolerance to a typical value of 0.3 mm. By increasing the diameter of the upwardly-extending pole piece 90 from its nominal diameter 100 of 25 mm to an enlarged pole diameter of 27 mm, indicated at 98 in the enlarged region 92 outside of the gap 104, the current invention increases the cross-sectional area of the pole piece 90 by 17%, and raises the total flux level in the gap by 38%. This is illustrated in the cross sectional view in FIG. 5. In the preferred embodiment of the present invention, this increase in flux is used to increase the net excursion limit 100%, or from 0.3 mm to 0.6 mm as seen in FIG. 6, and to increase the flux density by 4% from 1.65 T to 1.71 T (as illustrated in FIGS. 2 and 5).

As has been described above, the invention includes a magnetic circuit having a distally projecting pole piece member with minimal reluctance that allows the use of larger magnets, thicker front plates and realizes higher flux density in the air gap. The lower reluctance is achieved by increasing the distally projecting pole piece's outside diameter at all points spaced from and thus outside of the magnetic gap and outside the area swept by the voice coil at its maximum inward excursion (see FIGS. 4 and 5).

By increasing the distally projecting pole piece diameter over a substantial amount of its distally projecting length, the effective cross sectional area of the distally projecting pole piece is increased, thereby reducing the reluctance of this element of the magnetic circuit. Persons of skill in the art will see that the increase in diameter must be balanced with the potential to provide flux paths that divert flux away from the gap, and that the increased pole piece diameter must be located so that the voice coil will not contact the pole during any achievable excursion.

It will be appreciated by persons having skill in the art that the structure and method of the present invention can be used to provide gap flux enhancement by reduction of magnetic circuit reluctance in alternative magnetic circuit configurations. For example, the structure and method of the present invention may be applied to the outer magnetic path in pot type (cup type) speaker motor structures such as the structure 160 illustrated in FIG. 7, to enhance gap flux and reduce magnetic circuit reluctance. While the outer magnetic path in pot type magnetic circuits is not specifically constrained by geometry and driver parameters as is the pole in a traditional T-yoke design (e.g., as in FIG. 2), there may be other constraints limiting the outer diameter. Such constraints may be constraints of size for fit issues in a small enclosure or coaxial driver, or they may be constraints of cost and mass. The pot type embodiment 160 illustrated in FIG. 7 will have smaller OD, mass and cost than a larger OD motor that achieves the same results. Such an embodiment could have application in, but is not limited to, coaxial drivers, compression drivers, miniature transducers, microspeakers, annunciators, automotive and aerospace transducers as well as high fidelity audio applications.

The magnetic circuit structure 160 of the present invention provides both higher flux levels and longer linear flux range than prior art pot-type motor structures. As noted above, the amount of magnetic flux in the circuit is controlled by the amount of reluctance, where reluctance in a given circuit element is inversely proportional to the cross sectional area normal to the direction of the flux lines, and is proportional to the length of the circuit element, where the length is defined as the dimension of the element parallel to the flux lines, and the flux carrying capacity of the pot limits the thickness of the front plate to maintain high levels of magnetic saturation. The high levels of saturation are necessary to reduce overall inductance and non-linear inductance effects.

Figure 7:
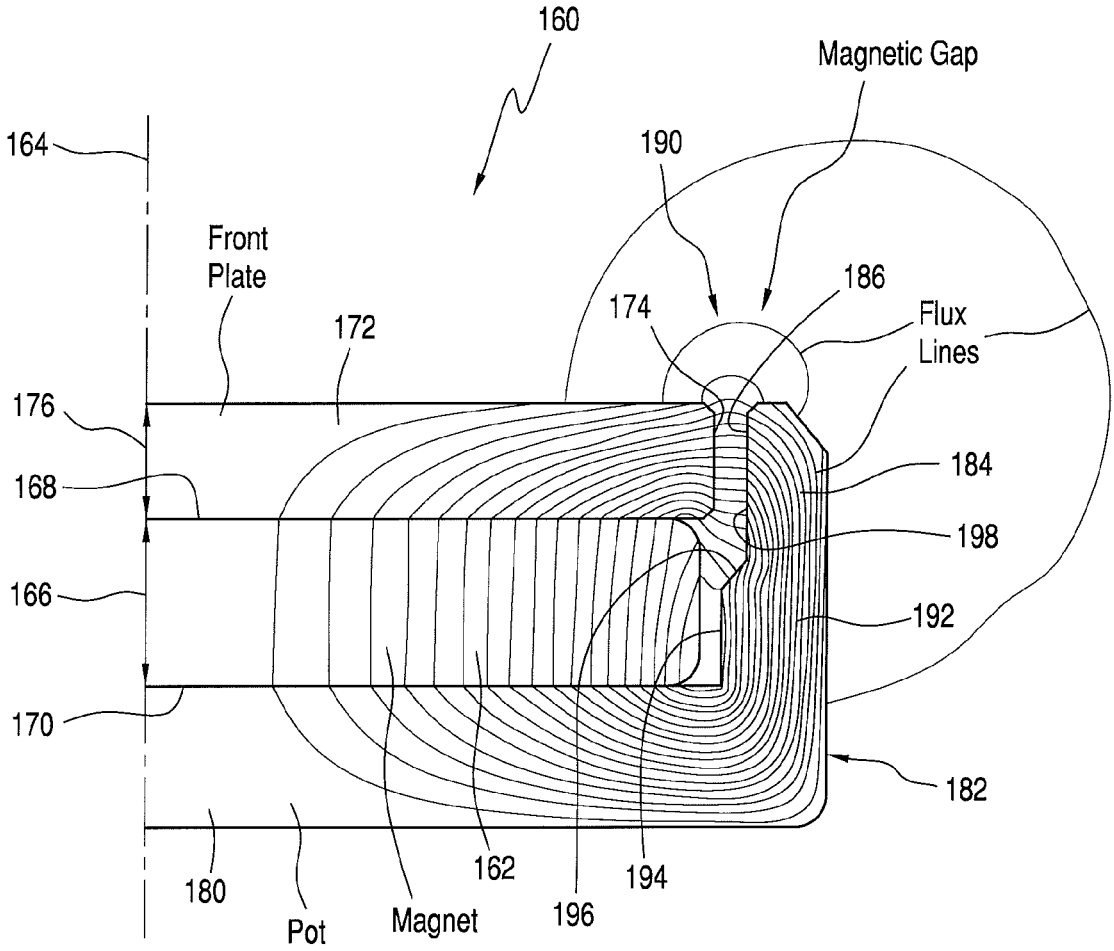
FIG. 7 illustrates a partial cross-sectional view of an alternative magnetic circuit suitable for so-called pot-type loudspeaker motor structures.

In general terms, the magnetic structure of transducer motor 160, as illustrated in FIG. 7, includes a disk shaped or circular permanent magnet 162 having a central axis 164 and having an axial length 166 along the axis. The magnet has a first pole at a first surface 168 and a second pole at a second surface 170. The magnetic structure also has a circular front plate 172 proximate the magnet's first surface 168 and the front plate has an outer circumferential edge 174 with a thickness 176 defined as the front plate outer edge axial length, where the front plate has a selected outside diameter. A rear pole piece, or pot 180 is proximate the magnet's second surface 170 and has a distally (upwardly in FIG. 7) projecting axially aligned outer sidewall 182 configured to receive and contain the magnet 162. The sidewall 182 terminates distally in a sidewall segment 184 having an inner edge surface 186, and an annular magnetic gap 190 is defined between the outer circumferential edge 174 of the front plate and the inner circumferential edge 198 of the distal sidewall segment 184. The distally projecting, axially aligned sidewall 182 has an enlarged reluctance-reducing segment 192 having an enlarged thickness, which results in a reduced inside diameter at 194 for the cup side wall 182 in this region. Sidewall segment 192 tapers distally and outwardly at 196 into a reduced-thickness distal wall segment at 184 having a second inside diameter at surface 198 which is larger than the inner diameter 194 of the sidewall segment 192.

The distally projecting sidewall's reluctance reducing thicker proximal segment's inside diameter 194 can be smaller than the front plate's outside diameter, and the sidewall's thicker proximal segment tapers at 196 to the thinner distal segment thickness at 184 at an axial length far enough from the magnetic gap to avoid creating excessive flux fringing (or loss of focus) away from the gap. It will be appreciated by persons of skill in the art that any increase in proximal sidewall segment thickness must be balanced with the potential to provide flux paths that divert flux away from the gap, and that the increase in distally projecting sidewall thickness must be located so that the voice coil which is to hang in the gap (not shown) will not contact the sidewall during any achievable excursion.

Having described preferred embodiments of a new and improved method, it is believed that other modifications, variations and changes will be suggested to those skilled in the art in view of the teachings set forth herein. It is therefore to be understood that all such variations, modifications and changes are believed to fall within the scope of the present invention as defined in the appended claims.

We claim:

1. An electro-dynamic loudspeaker transducer motor structure, comprising:

(a) an annular magnet having a central lumen defined around an axis and having an axial length, said magnet being oriented with a first magnetic pole at a first magnet surface and a second opposing pole at a second magnet surface;

(b) an annular front plate proximate the magnet's first surface and having a front plate central lumen coaxially aligned with said magnet's central lumen and defining an inner edge with a thickness defined as front plate inner edge axial length, wherein said front plate lumen has a selected lumen inside diameter;

(c) a rear pole piece proximate the magnet's second surface and having distally or frontwardly projecting axially aligned elongated pole piece segment configured to be received in the magnet's central lumen, said elongated pole piece having a sidewall with an outer circumferential edge;

(d) wherein an annular magnetic gap is defined between the inner edge of the front plate and the outer circumferential edge of the sidewall of the distally projecting pole piece;

(e) wherein the distally projecting axially aligned pole piece's sidewall has an enlarged, proximal segment having an enlarged outside diameter and a distal segment having a second outside diameter which is smaller than said enlarged outside diameter; and (f) wherein said distally pole piece sidewall proximal segment's enlarged outside diameter is larger than said front plate's selected lumen inside diameter.

2. The electro-dynamic loudspeaker transducer motor structure of claim 1, wherein the distally projecting pole piece's enlarged proximal segment's outside diameter is larger than the front plate lumen's inside diameter from a proximal end of the pole piece sidewall to a stepped portion of the sidewall which is proximally spaced from said annular magnetic gap.

3. The electro-dynamic loudspeaker transducer motor structure of claim 2, further comprising a substantially planar bucking magnet carried on said pole piece, opposite said annular magnet and configured to contribute flux via said distally projecting pole piece's enlarged proximal segment.

4. A tweeter including a diaphragm driven by a voice coil suspended in the gap of the motor structure of claim 1, wherein the distally projecting pole piece's enlarged proximal segment's outside diameter is at least 27 mm, thus increasing the pole area and raising the total flux level, as compared to cylindrical pole piece tweeters.

5. The tweeter and motor structure of claim 4, wherein the distally projecting pole piece's enlarged proximal segment's outside diameter generates an increased total flux level which enables an increase in the net excursion limit to 0.6 mm.

6. The tweeter and motor structure of claim 4, wherein the distally projecting pole piece's enlarged proximal segment's outside diameter generates an increased flux density of at least 1.71 T.

7. A pot-style electro-dynamic loudspeaker transducer motor structure, comprising:

(a) a disc shaped permanent magnet defined around an axis and having an axial length, a first pole at a first circular surface and a second pole at a second circular surface;

(b) a circular front plate proximate the magnet's first circular surface and defining an outer circumferential edge surface with, a thickness defined as front plate outer edge axial length, wherein said front plate has a selected outside diameter;

(c) a rear pole piece or pot proximate the magnet's second circular surface and having a distally projecting axially aligned side wall segment configured to receive the disc shaped magnet, wherein said side wall segment has an inner edge surface;

(d) wherein an annular magnetic gap is defined between the outer circumferential edge surface of the front plate and the inner edge surface of the sidewall of the distally projecting sidewall segment; and (e) wherein the distally projecting axially aligned side wall has an enlarged, thicker proximal segment having a reduced inside diameter and a thinner front or distal segment having a second inside diameter which is larger than said proximal sidewall segment's inside diameter to provide a transducer magnetic circuit having reduced reluctance and generating higher flux density.

8. The pot-style electro-dynamic loudspeaker transducer motor structure of claim 7, wherein the distally projecting side wall enlarged proximal segment's inside diameter tapers outwardly and distally toward the sidewall's distal segment.

9. The pot-style electro-dynamic loudspeaker transducer motor structure of claim 8, wherein the distally projecting side wall enlarged proximal segment's inside diameter is smaller than the front plate's outside diameter.

10. A tweeter including a diaphragm driven by a voice coil suspended in the gap of the motor structure of claim 7, wherein the distally projecting side wall's enlarged proximal segment's inside diameter is smaller than the front plate's outside diameter, thus raising the total flux level, as compared to standard pot-style tweeter magnetic circuits.

11. A tweeter including a diaphragm driven by a voice coil suspended in the gap of the motor structure of claim 7, wherein the distally projecting side wall's enlarged proximal segment's inside diameter is smaller than the front plate's outside diameter, thus providing a longer linear flux range, as compared to standard pot-style tweeter magnetic circuits.

12. A tweeter including a diaphragm driven by a voice coil suspended in the magnetic gap of the motor structure of claim 2, wherein said distally projecting pole piece member provides a magnetic circuit with lower magnetic reluctance and realizes higher flux density in said magnetic gap;

wherein said lower reluctance is achieved by increasing the distally projecting pole piece's outside diameter at all points spaced from and thus outside of the magnetic gap.

13. The tweeter of claim 12, wherein said lower reluctance is achieved by increasing the distally projecting pole piece's outside diameter at all points spaced from and thus outside of an area swept by the voice coil at its maximum inward excursion.

14. The tweeter of claim 13, wherein said enlarged outside diameter of said upwardly-extending pole piece increases the net excursion limit to 0.6 mm.

15. The tweeter of claim 12, wherein said distally projecting pole piece's outside diameter is increased at all points spaced proximally from said magnetic gap by 0.6 mm or more so the distally projecting pole piece's enlarged proximal segment's outside diameter is larger than the front plate lumen's inside diameter from a proximal end of the pole piece sidewall to a stepped portion of the sidewall which is proximally spaced from said annular magnetic gap by at least 0.6 mm.

* * * * *

UNITED STATES PATENT AND TRADEMARK OFFICE

CERTIFICATE OF CORRECTION

PATENT NO. : 9,282,410 B2
APPLICATION NO. : 14/338088
DATED : March 8, 2016
INVENTOR(S) : Gladwin et al.

It is certified that error appears in the above-identified patent and that said Letters Patent is hereby corrected as shown below:

In the Claims:

In claim 1, column 9 line 3 reads:

"wherein said distally pole piece sidewall proximal seg-"

It should read:

"wherein said distally projecting pole piece sidewall proximal seg-"

Signed and Sealed this
Twenty-eighth Day of June, 2016

Michelle K. Lee

Michelle K. Lee
*Director of the United States Patent and Trademark Office*